US005768216A

United States Patent [19]

Obata et al.

[11] Patent Number: 5,768,216

[45] Date of Patent: Jun. 16, 1998

[54] FLEXITENSIONAL TRANSDUCER HAVING A STRAIN COMPENSATOR

[75] Inventors: Hidenori Obata; Tomohiro Tsuboi; Takashi Yoshikawa; Akiyoshi Kawamori, all of Tokyo, Japan

[73] Assignee: Oki Electric Industry Co., Ltd., Tokyo, Japan

[21] Appl. No.: 672,028

[22] Filed: Jun. 26, 1996

[30] Foreign Application Priority Data

Jun. 28, 1995 [JP] Japan ..... 7-162502

[51] Int. Cl.[6] ..... H04R 17/00

[52] U.S. Cl. ..... 367/172; 367/162; 367/167; 367/176; 310/337

[58] Field of Search ..... 367/162, 164, 367/165, 172, 173, 176, 167; 310/337

[56] References Cited

U.S. PATENT DOCUMENTS

| | | | |
|---|---|---|---|
| 2,064,911 | 12/1936 | Hayes | 367/151 |
| 3,258,738 | 6/1966 | Merchant | 367/155 |
| 4,420,826 | 12/1983 | Marshall, Jr. et al. | 367/167 |
| 4,845,687 | 7/1989 | Bromfield | 310/337 |
| 4,964,106 | 10/1990 | Bromfield | 367/165 |
| 5,345,428 | 9/1994 | Arnold et al. | 367/165 |
| 5,363,346 | 11/1994 | Maltby | 367/163 |
| 5,431,058 | 7/1995 | Lagier et al. | 310/337 |

FOREIGN PATENT DOCUMENTS

WO 9213338 8/1992 European Pat. Off. .

OTHER PUBLICATIONS

"The Dynamic Filter Device", International Workshop on Power Transducers for Sonics and Ultrasonics, Jun. 1990, pp. 82–83.

*Primary Examiner*—Ian J. Lobo

*Attorney, Agent, or Firm*—Rabin, Champagne, & Lynt, P.C.

[57] ABSTRACT

In a flextensinal transducer a drive stack provided inside the oval shell has a strain compensator that has a cylinder and piston. The cylinder is provided in the oval shell, and the piston is stiffly attached to the end of the drive stack. Inside the cylinder, the piston can move along the major axis of the oval shell. When the flextensional transducer is sunk into the water, the oval shell is distorted to extend along the major axis. Then the cylinder and the piston moves relatively to each other to compensate for the distortion.

25 Claims, 8 Drawing Sheets

FLEXITENSIONAL TRANSDUCER HAVING A STRAIN COMPENSATOR

BACKGROUND OF THE INVENTION

This invention relates to an active sonar, and especially relates to flextensional transducer.

Generally the flextensional transducer is utilized under water. It is utilized to find solid objects existing under water.

In order to find those objects, the flextensional transducer generates sonic waves of a certain frequency.

The sonic waves are radiated around the transducer, and will be reflected at the surface of the solid target objects.

In the reflection process of the sonic waves, it takes a certain amount of reflection process time for the sonic wave to be radiated from the transducer, reflected by the surface of the target, and return to a detector, or the transducer, which may be able to detect the reflected sonic wave. The reflection process time is, as well known, in proportion to a travel distance of the sonic wave. So, detecting the reflection process time shows the travel distance of the sonic wave.

The reflection process time also depends on the relative position of the target and transducer. So, a plurality of transducers positioned apart will each detect different process times. By detecting those different process times, relative distances can be calculated according to the proportional relation of the reflection process time and travel distance, of the sonic wave. Then, it is easy to conceive, with the calculated distances, an imaginary polygon which has the target on one apex and has transducers on the other apexes. The polygon shows the position where the target exists.

This target position detection utilizes relatively high frequency sonic waves. In other words, the detection utilizes short wavelength sonic waves; because the wavelength determines the detection accuracy of the travel distance detection.

DESCRIPTION OF THE RELATED ART

The basic idea of the flextensional transducer is well known, and is disclosed by Hayes' 1936 patent, titled "Sound Generating and Directing Apparatus".

In general, a flextensional transducer is essentially comprised of an oval shell and drive stack. Utilizing those materials, the flextensional transducer provides a Helmholtz resonator. The following explanation will show how the Helmholtz resonator is used in the flextensional transducer.

FIG. 1 shows a sectional view of the typical flextensional transducer.

As shown in the figure, the flextensional transducer is essentially comprised of two parts. One is an oval shaped shell, and the other is a drive unit positioned within the oval shell.

The oval shell has a waterproof construction. The oval shell prevents water from sinking inside the shell. The oval shell also keeps its shape against hydrostatic pressure.

Inside the oval shell, a drive stack is installed along the major axis of the oval shell. The drive stack is made of thin blocks piled up in the major axis. The thin block is made of piezoelectric ceramics. Those blocks have piezoelectric effectes, that strains when the blocks are electrically energized. Each block is electrically connected to an alternative current power source (not shown). An example of the circuit is disclosed in FIG. 2 of U.S. Pat. No. 3,258,738, titled "UNDER WATER TRANSDUCER APPARATUS".

The drive stack is primarily compressed by the shell along the major axis.

The compressing stress compensates tensile stress on the drive stack, which is fragile against such tensile stress because it is mainly made of piezoelectric ceramic blocks. The tensile stress is caused by distortion of the oval shell, and the distortion is caused by the hydrostatic pressure. The hydrostatic pressure is loaded uniformly on the oval surface of the shell, and the shell is distorted so that the oval shape is extended along the major axis. This distortion extends the drive stack along its major axis, causing the stack to generate a tensile stress. Accordingly, the maximum allowable tensile stress against the drive stack is 80 MPa, corresponding to about 150 m depth under water in a 350 Hz flextensional design case. That means the drive stack may not bear the subject forces, in case the flextransducer is sunk under the 150 m depth. In order to avoid this fatal problem, 25 MPa compressing stress is required in order to increase the depth limitation from 150 m depth to 220 m depth.

The compressing stress is loaded on the drive stack by the oval shell in most currently used transducers. In early transducers, the compressing stress was loaded with tension lods that extend parallel to the drive stack and compresses the drive stack.

In the design process of the transducer, it is important to maintain the compressing stress at a predetermined amount. The compressing stress affects the transmission characteristics of the sonic wave from the drive stack to the oval shell. In order to maintain the compressing stress, the following solution was adopted in the prior transducers.

FIG. 2 shows the sectional view of the transducer. When the oval shell does not bear the hydrostatic pressure, the oval shell has a round sectional shape as 101*a*. When the transducer is exposed in the air, the oval shell takes this shape.

Inside the oval shell 101, drive stack 102 has a round portion on both its ends. The round portions are each attached to the inner surface of the oval shell 101 at the position a1 and a2. The drive stack 101 is also compressed by the shell 101 in the lateral direction of the figure, and is slightly shortened.

However, once the transducer is thrown into the sea, the oval shell is distorted as 101*b*, by the hydrostatic pressure. The oval shell is pressed in the vertical direction of the figure, and elongated in the lateral direction of the figure.

Then, the inner surface moves according to the shell 101, but the round portions of the drive stack 102 do not follow. The round portions stay still against the inner surface. Accordingly, the attached point moves from the point a1 to b1 and b2, and from the point a2 to b3 and b4.

In this process, it is apparent that the physical relation between the hydrostatic pressure and shell distortion is seriously restricted in order to maintain the compressing stress on the drive stack. In order to maintain the compressing stress, the inner surface must distort so that the drive stack will never be elongated or shortened even when the attached point moves as cited above. This poses a serious engineering problem in designing or manufacturing the oval shell. The maintaining condition must be held regardless of the hydrostatic pressure.

SUMMARY OF THE INVENTION

In order to solve the engineering problem, this invention provides an advanced flextensional transducer, in which the drive stack has a strain compensator on at least one end of the stack. The strain compensator mechanically connects the oval shell and the drive stack.

The strain compensator comprises a cylinder in one major end of the oval shell. A piston is inserted in the cylinder so that the piston can move along the major axis of the oval shell. The piston is stiffly connected to one end of the drive stack.

By way of this construction, the piston may vibrate along the major axis of the oval shell when the drive stack generates relatively high vibration. And the piston may also move relatively against the cylinder along the major axis of the oval shell when the flextensional transducer is sunk under water and the cylinder moves along the major axis of the oval shell according to the distortion of the oval shell.

The piston has a hole penetrating along the major axis of the oval shell. The rest space of the cylinder of the shell is filled with fluid.

According to that design, the strain compensator has its own hydrostatic pressure, so the strain compensator prevents certain vibrations or movements which have lower frequencies than the resonance frequency. Those low frequency vibrations contain, for example, oval shell distortion caused by the hydrostatic pressure. The hydrostatic pressure slowly progresses relatively in proportion to the depth of the flextensional transducer as the flextensional transducer sinks below the water. The hydrostatic pressure progress may be regarded as a vibration of extremely low frequency. On the contrary, sonic frequency vibration being generated in the drive stack is a high vibration. For example, 350 Hz vibration is employed in class IV flextensional transducers.

FIGS. *5a–5d* are sectional views showing a piston moving in the cylinder.

FIGS. *6a* and *6b* illustrate the transition of the piston fluid in relation to frequency.

FIGS. *7a–7c* are sectional views showing a further embodiment in which a diaphragm bends by the hydrostatic pressure.

Figure 8:
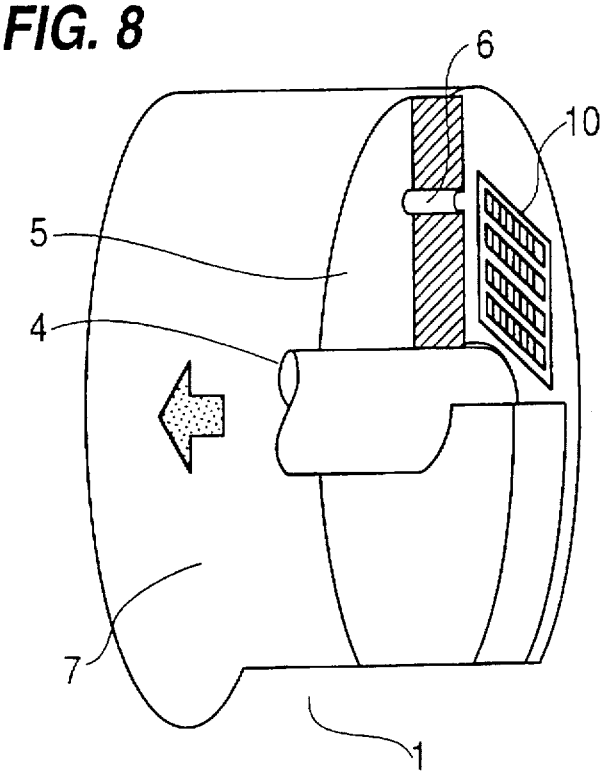

FIG. 8 is a sectional view of the present invention that shows an electric heater attached inside the cylinder.

Figure 9:
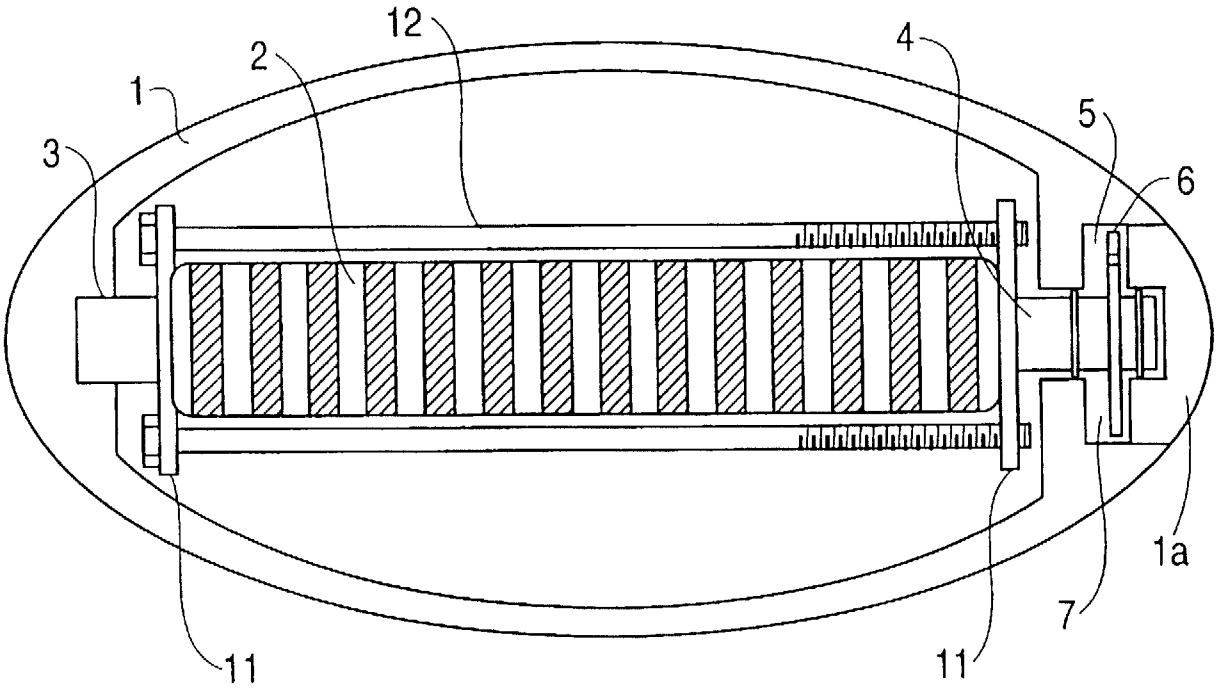

FIG. 9 is a sectional view that shows the oval shell of the invention with a detachable spacer.

DESCRIPTION OF THE PREFERRED EMBODIMENTS

Figure 1:
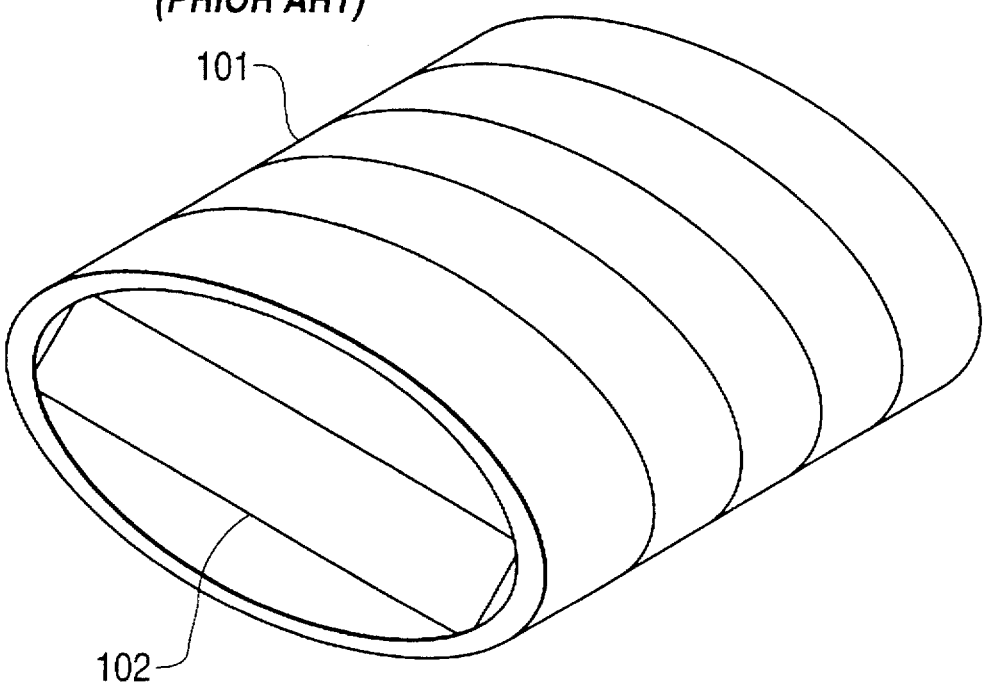
FIG. 1 (PRIOR ART)
FIG. 1 is a perspective view of a prior art flextensional transducer.
Figure 2:
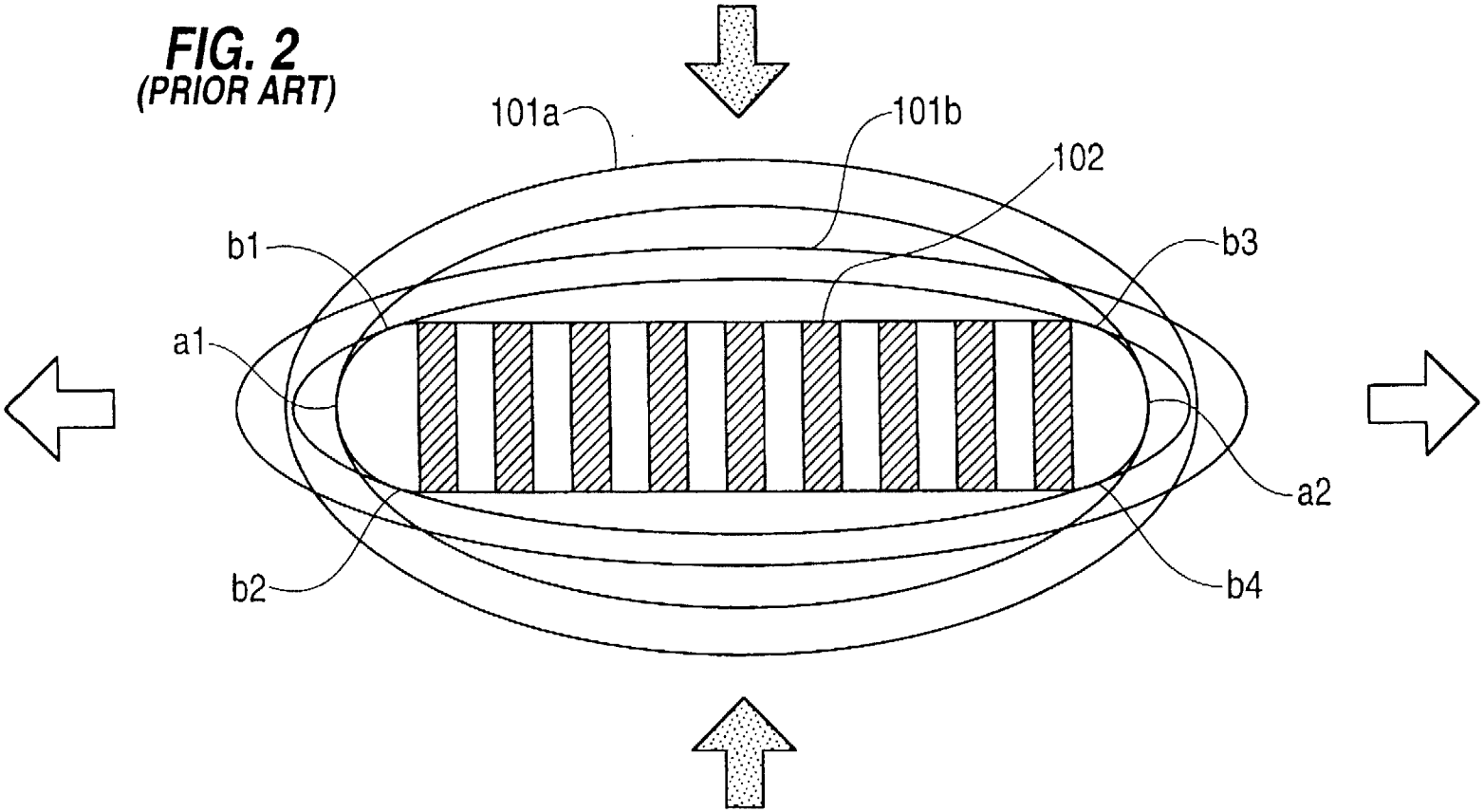
FIG. 2 (PRIOR ART)
FIG. 2 is also a sectional view of a prior art flextensional transducer.
Figure 3:
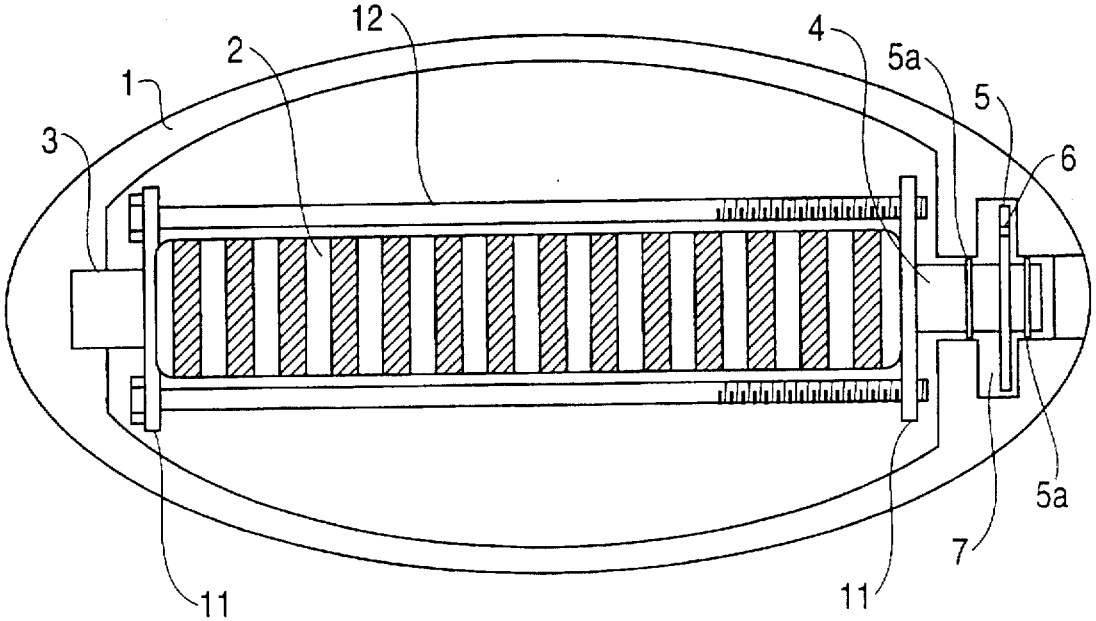
FIG. 3 is a sectional view of the inner structure of an embodiment of the invention.

FIG. 3 shows a sectional view of a flextensional transducer of a preferred embodiment of this invention. As shown in the figure, Inside the shell 1 is an elongated drive stack 2. This drive stack 2 is comprised of piezoelectric ceramic blocks built up in the longitudinal direction. The piezoelectric ceramic block distorts to change its dimension when it receives voltage therethrough. Accordingly, if the voltage is alternative, the piezoelectric ceramic block generates a vibration. The frequency vibration is substantially the same as the alternative voltage frequency.

Also as shown in the FIG. 3, the drive stack 2 is elongated along the major axis of the oval shell 1. Each end of the drive stack 2 is attached to the oval shell 1 with shafts 3 and 4. One end of the drive stack 2, which is shown as the left end in the figure, is stiffly attached to the oval shell 1 with shaft 3. The shaft 3 translates the vibration of the drive stack 2 to the oval shell 1 well. The other end of the drive stack, which is shown as the right end in the figure, is movably connected to the oval shell 1 with shaft 4, and piston 5 in the cylinder 7. The shaft 4 is mechanically supported by the oval shell 1 so that the shaft 4 is movable along its major axis.

The drive stack 2 is also stiffly connected to the piston 5 with shaft 4. On both sides of the piston 5, an O-ring 5a is provided on the shaft 4. The O-ring 5a engages with to the cylinder 7 to prevent the fluid from leaking out of the cylinder 7. The shaft 4 translates vibration from the drive stack 2 to the piston 5. However, the piston 5 is movably inserted into the cylinder 7. The cylinder 7 is, as shown in the FIG. 3, mounted on the oval shell 1 at one end of the oval shell 1. The cylinder 1 is elongated along the major axis of the oval shell 1. Within the cylinder, the piston 5 is slidable along the major axis of the oval shell 1.

On both end of the drive stack 2 are attached compression plates 11. Both plates 11 are tied with tension rods 12. Plates 11 and tension rods 12 have screw pitch, and both plates 11 compress the drive stack 2 by screwing the tension rods 12. Accordingly, the drive stack 2 generates compressing stress.

Figure 4:
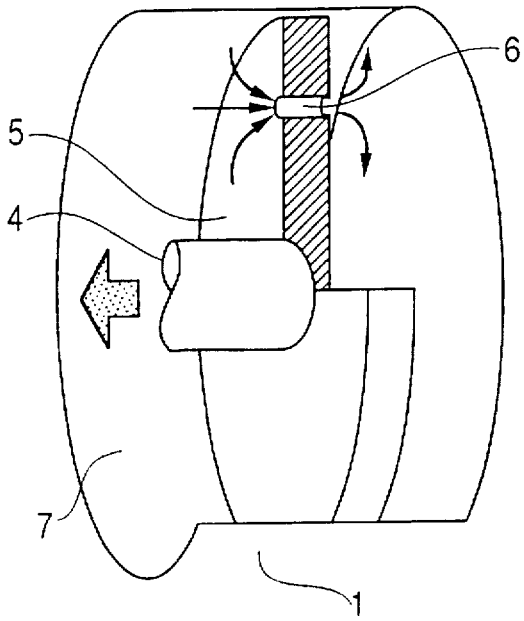
FIG. 4 is a sectional view of the inner structure of a piston assembly, as used in the invention.
Figure 5A:
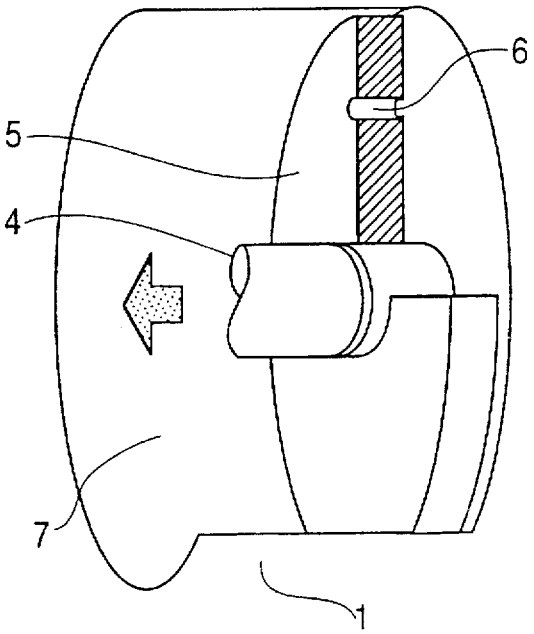
Figure 5B:
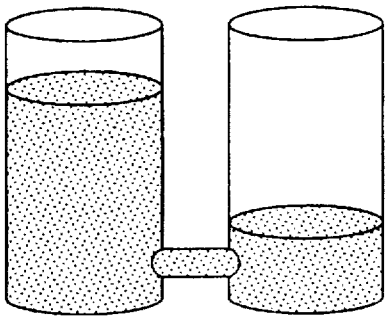
Figure 5C:
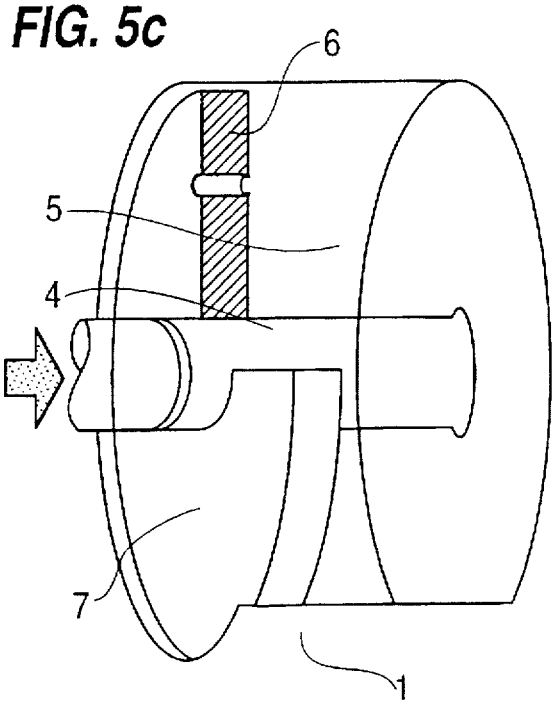
Figure 5D:
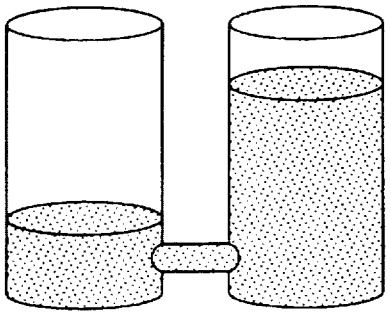
Figure 6A:
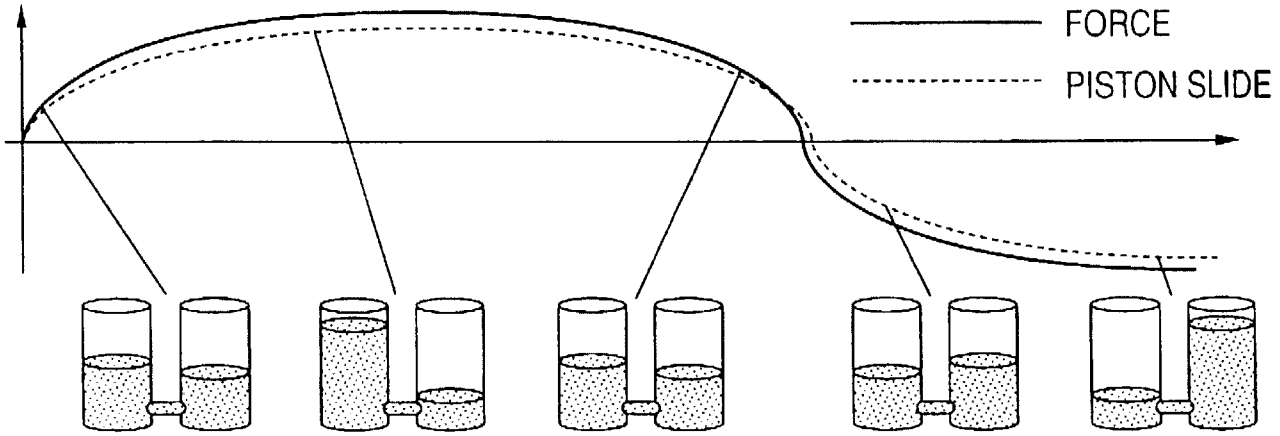
Figure 6B:
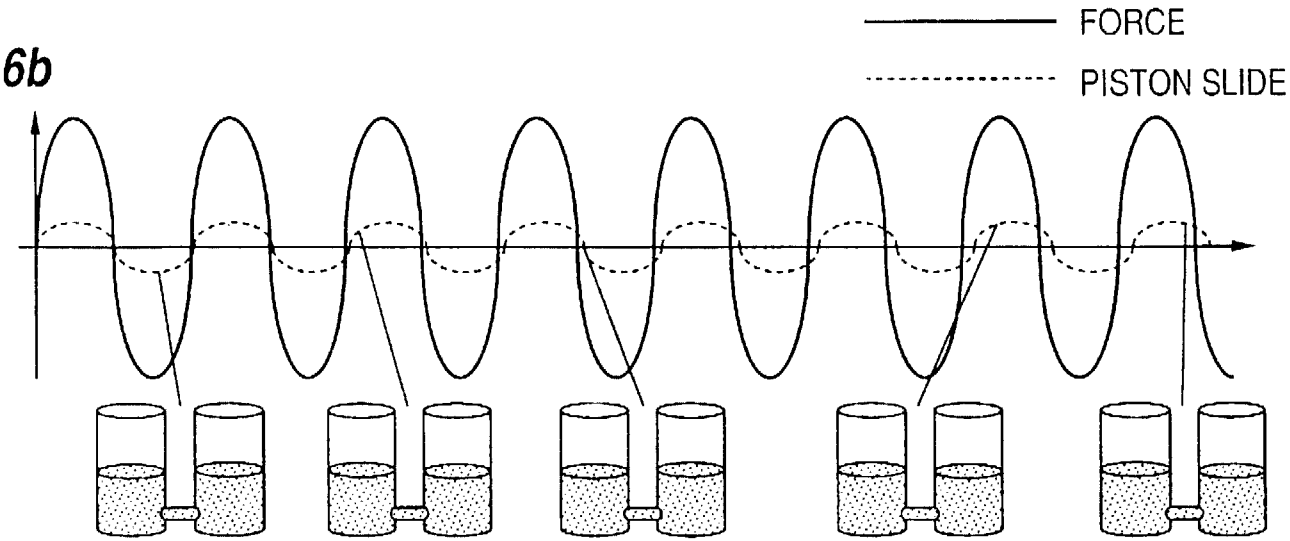
Figure 7B:
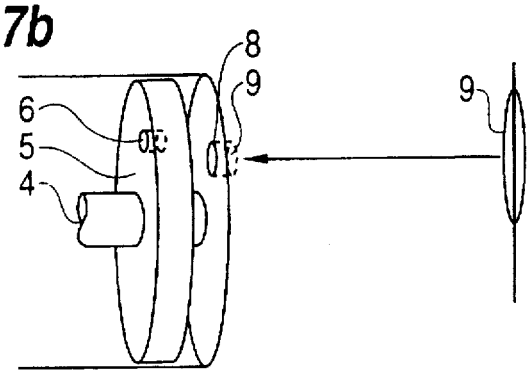
Figure 7A:
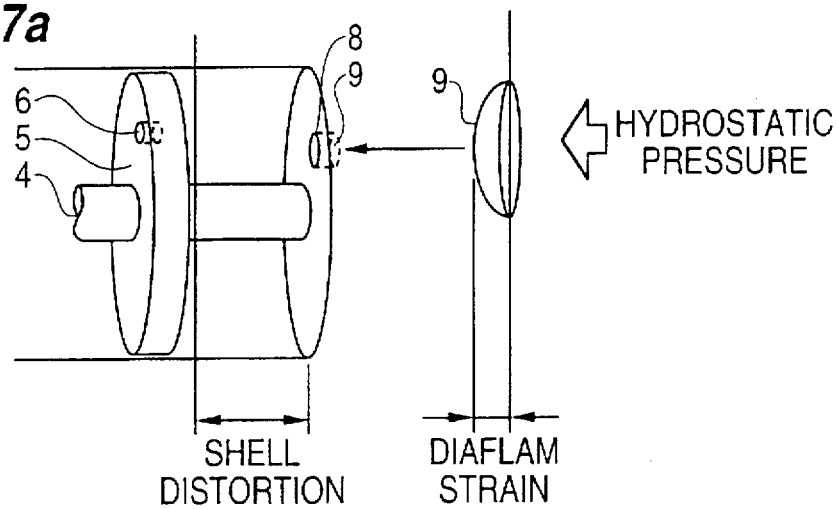
Figure 7C:
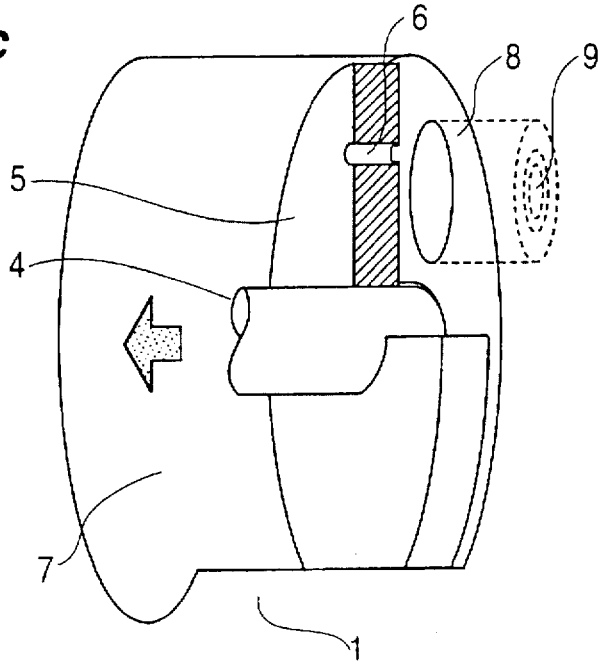

FIG. 4 shows an enlarged sectional view around the piston 5.

As shown in FIG. 4, the piston 5 has a penetrating hole 6 extending along its slidable direction. Around the piston 5, the cylinder 7 is filled with fluid. Also, the hole 6 is filled with the fluid. Although not shown in the figure the fluid has a specific viscosity. The fluid passes through the hole 6 when the piston 5 slides inside the cylinder 7. When the fluid passes through the hole 6, the fluid resists the slide action of the piston 5, due to the viscosity of the fluid, and dynamic friction between the fluid and the piston along the hole 6. The resistance depends on the fluid viscosity, diameter of the hole 6, diameter of the cylinder 7, and the sliding speed of the piston 5.

Especially, the higher the sliding speed gets, the greater the resistance becomes. And the sliding speed is in proportion to the vibrating frequency of the drive stack 2. In the case the vibrating frequency is higher than a certain frequency, the resistance becomes so great that the fluid acts as a solid material.

FIGS. *5a–5d* show conceptional illustrations that explain the fluid passing through the hole 6 when the piston 5 goes and returns slowly inside the cylinder 7.

In FIGS. *5a* and *5b*, the fluid is prevented from passing thorough the hole 6. Accordingly, the fluid transmits the vibrations of high frequency well. The drive stack is provided with the alternative voltage of such high frequency. Accordingly, the vibration of the drive stack will be well transmitted to the oval shell, through the shaft 4, piston 5, fluid, and the cylinder 7. When the piston 5 is positioned at the extended side (shown as the right side in the FIG. *5a*), most of the fluid is gathered in the side of the cylinder 7 that the shaft 4 extends wherein. However, once the piston 5 slides to the shrink side (shown as the left side in the FIG. *5c*), the fluid passes through the hole 6 without resistance, and pour into the other side of the cylinder 7. It is the same case that the cylinder 7 itself slides against the piston, in the major axis of the shaft 4.

FIGS. *6a* and *6b* show comparing explanations of the fluid transition in two different cases as cited above, of low frequency and high frequency. In the low frequency case, the fluid transits smoothly according to the piston slide, but in the high frequency case, the fluid cannot transit through an extremely high speed corresponding to piston slide speed. Then the fluid prevents the piston from sliding at high speed corresponding to high frequency. As a result, the piston 5 cannot slide at a sufficient amplitude as in the low frequency case.

In an actual active sonar case, the cylinder 7 slides slowly like the low frequency case, because the hydrostatic pressure distorts the oval shell 1 and move the cylinder 7 gradually. On the contrary, the piston 5 slides fast like the high frequency case, because the drive stack vibrates the piston at a high frequency. Accordingly, the cylinder 7 and the piston 5 easily slide by the hydrostatic pressure, but they hardly slide by the vibration from the drive stack 2. As a result, the vibration from the drive stack 2 will be transmitted to the oval shell 1 without loss.

FIGS. *7a–7c* show a second embodiment of this invention. Although the second embodiment resembles the first embodiment cited above, it is characterized in that the the oval shell 1 comprises a path 8 and a diaphragm 9. The path 8 connects the cylinder 7 with the space outside of the oval shell 1. At the outer end of the path 8, diaphragm 9 covers the path 8. Because of the diaphragm 9, ocean water is prevented from pouring into the cylinder 7, and the fluid is also prevented from ejecting out of the cylinder 7. However, the diaphragm 9 conducts the pressure outside of the oval shell 1 to the fluid.

In the second embodiment, the fluid keeps its pressure at an adequately high value. This pressure prevents cavitation of the fluid from occurring.

As shown in FIG. *7b*, the diaphragm 9 keeps its flat shape when the oval shell 1 is exposed in the atmosphere. In this condition, the fluid filled in the cylinder 7 or the path 8 is not subject to pressure except atmosphere pressure. However, when the oval shell is thrown into the ocean, the diaphragm 9 receives hydrostatic pressure to be bent toward the inside of the Shell 1. Then, the fluid in the path 8 is subjected to the same pressure by the bend.

The pressure is then conducted to the fluid in the cylinder 7 through the path 8. Accordingly, the fluid in the cylinder 7 keeps the fluid pressure equal to the hydrostatic pressure outside the oval shell 1.

This eqality prevents cavitation of the fluid from occuring around the piston 5, when the piston 5 vibrates with a large amplitude. It will ensure that the vibration will be conducted through the fluid at high efficiency, from the shaft 4 to the oval shell 1.

FIG. 8 shows third embodiment of this invention. In FIG. 8, an electric heater 10 is attached on the inner surface of the cylinder 7. The electric heater 10 is electrically connected to a power source (not shown) to be energized.

When the electric heater 10 is energized, it raises fluid temperature. Then, the fluid pressure is also raised in the limited space inside the cylinder 7. This prevents cavitation of the fluid from occuring around the piston 5, when the piston 5 vibrates with large amplitude. It will ensure that the vibration will be conducted through the fluid at a high efficiency, from the shaft 4 to the oval shell 1. The third embodiment resembles the second embodiment cited above, in that the fluid pressure is raised to prevent cavitation.

FIG. 9 shows fourth embodiment of this invention. In FIG. 9, oval shell 1 has detachable spacer 1*a*. When assembling the flextensional transducer, detachable spacer 1*a* can be attached after providing the fluid into the cylinder 7.

What we claim is:

1. A flextensional transducer, comprising:

an oval shell;

a drive stack provided within said oval shell, extending along a major axis of said oval shell, and being mechanically connected to said oval shell; and a strain compensating device connecting said drive stack to said oval shell, and including a movable structure slidably connecting said drive stack to said oval shell and allowing said drive stack to move relative to said oval shell along the major axis, the movement of said movable structure being variably restrictable using a fluid, whereby said strain compensating device compensates for a strain resulting from a vibration occurring at a frequency which is lower than a predetermined resonance frequency of said strain compensating device, and transmits vibrations occurring at the predetermined resonance frequency.

2. The flextensional transducer cited in claim 1; wherein said strain compensating device is comprised of a piston and a cylinder, said piston being provided in said cylinder so that said piston can move along the cylinder, one of said piston or said cylinder being mechanically connected to said oval shell, and the other of said piston or said cylinder being mechanically connected to one end of said drive stack so that said piston and said cylinder can relatively move along said major axis of said oval shell.

3. The flextensional transducer cited in claim 2; wherein said cylinder is filled with the fluid.

4. The flextensional transducer cited in claim 3; wherein said piston has at least one hole penetrating said piston so that said fluid can move through said hole when said piston moves relative to said cylinder.

5. The flextensional transducer cited in claim 2; wherein said cylinder has at least one pressure adjusting device which adjusts the pressure of said fluid.

6. The flextensional transducer cited in claim 3; wherein said cylinder has a least one pressure adjusting device which adjusts the pressure of said fluid.

7. The flextensional transducer cited in claim 4; wherein said cylinder has at least one pressure adjusting device which adjusts the pressure of said fluid.

8. The flextensional transducer cited in claim 5; wherein said pressure adjusting device includes a connecting path through which a pressure of said fluid is adjusted to be the same as hydraulic pressure outside said oval shell.

9. The flextensional transducer cited in claim 6; wherein said pressure adjusting device includes a connecting path through which a pressure of said fluid is adjusted to be the same as hydraulic pressure outside said oval shell.

10. The flextensional transducer cited in claim 7; wherein said pressure adjusting device includes a connecting path through which a pressure of said fluid is adjusted to be the same as hydraulic pressure outside said oval shell.

11. The flextensional transducer cited in claim 5; wherein said pressure adjusting device comprises a heating device that heats said fluid.

12. The flextensional transducer cited in claim 6; wherein said pressure adjusting device comprises a heating device that heats said fluid.

13. The flextensional transducer cited in claim 7; wherein said pressure adjusting device comprises a heating device that heats said fluid.

14. The flextensional transducer cited in claim 2, wherein said oval shell has a detachable device that opens said cylinder.

15. The flextensional transducer cited in claim 3, wherein said oval shell has a detachable device that opens said cylinder.

16. The flextensional transducer cited in claim 4, wherein said oval shell has a detachable device that opens said cylinder.

17. The flextensional transducer cited in claim 5, wherein said oval shell has a detachable device that opens said cylinder.

18. The flextensional transducer cited in claim 6, wherein said oval shell has a detachable device that opens said cylinder.

19. The flextensional transducer cited in claim 7, wherein said oval shell has a detachable device that opens said cylinder.

20. The flextensional transducer cited in claim 8, wherein said oval shell has a detachable device that opens said cylinder.

21. The flextensional transducer cited in claim 9, wherein said oval shell has a detachable device that opens said cylinder.

22. The flextensional transducer cited in claim 10, wherein said oval shell has a detachable device that opens said cylinder.

23. The flextensional transducer cited in claim 11, wherein said oval shell has a detachable device that opens said cylinder.

24. The flextensional transducer cited in claim 12, wherein said oval shell has a detachable device that opens said cylinder.

25. The flextensional transducer cited in claim 13, wherein said oval shell has a detachable device that opens said cylinder.

* * * * *